US010299604B2

(12) United States Patent
Fissette et al.

(10) Patent No.: US 10,299,604 B2
(45) Date of Patent: May 28, 2019

(54) MASSAGE MOTOR SUSPENSION SYSTEM

(71) Applicant: ERGOMOTION, INC., Goleta, CA (US)

(72) Inventors: Matthew Fissette, Santa Barbara, CA (US); Joseph Ermalovich, Santa Barbara, CA (US)

(73) Assignee: ERGOMOTION, INC., Goleta, CA (US)

( * ) Notice: Subject to any disclaimer, the term of this patent is extended or adjusted under 35 U.S.C. 154(b) by 312 days.

(21) Appl. No.: 15/257,757

(22) Filed: Sep. 6, 2016

(65) Prior Publication Data

US 2017/0065092 A1 Mar. 9, 2017

Related U.S. Application Data

(60) Provisional application No. 62/215,501, filed on Sep. 8, 2015.

(51) Int. Cl.
*A61H 23/02* (2006.01)
*A47C 21/00* (2006.01)

(52) U.S. Cl.
CPC ..... *A47C 21/006* (2013.01); *A61H 23/02* (2013.01); *A61H 23/0254* (2013.01); *A61H 2201/0142* (2013.01); *A61H 2201/0146* (2013.01); *A61H 2201/14* (2013.01); *A61H 2201/164* (2013.01); *A61H 2201/1623* (2013.01); *A61H 2201/1633* (2013.01)

(58) Field of Classification Search
CPC .... A61H 23/00; A61H 23/02; A61H 23/0254; A61H 2201/164; A61H 2201/1633; A61H 2201/1623; A61H 2201/14; A61H 2201/0138; A61H 2201/0142; A61H 2201/0146; A61H 2201/0149; A61G 2201/0183; A61G 2201/0142; A61G 2201/0146; A61G 2201/0149; A47C 21/00; A47C 21/006
See application file for complete search history.

(56) References Cited

U.S. PATENT DOCUMENTS 1,845,941 A * 2/1932 Stevens ..... A61H 23/0263 310/81
3,035,572 A * 5/1962 Houghtaling ..... A61H 23/0263 601/60
3,092,100 A * 6/1963 Oetinger ..... A47C 1/0355 601/57
3,194,522 A * 7/1965 Azneer ..... A47C 21/006 248/624
3,613,673 A * 10/1971 La Hue ..... A61H 23/0236 601/59
3,732,860 A * 5/1973 Thurmer ..... A47C 21/006 5/109
4,105,024 A * 8/1978 Raffel ..... A61H 9/0078 5/674

(Continued)

*Primary Examiner* — Robert G Santos
*Assistant Examiner* — David R Hare
(74) *Attorney, Agent, or Firm* — Felix L. Fischer

(57) ABSTRACT

A massage motor suspension system incorporates a frame which is secured to a planar support. A sling supporting a massage motor is resiliently suspended from the frame. A massage holder clipped to the massage motor engages a bottom surface of a mattress on the planar support through an aperture in the planar support.

7 Claims, 10 Drawing Sheets

(56) References Cited

U.S. PATENT DOCUMENTS 4,326,506 A * 4/1982 Kawabata ..... A61H 1/00 5/694
5,014,687 A * 5/1991 Raffel ..... A47C 3/02 601/58
5,140,977 A * 8/1992 Raffel ..... A47C 3/02 5/915
5,713,832 A * 2/1998 Jain ..... A61H 1/00 601/49
5,940,914 A * 8/1999 Robbins ..... A47C 20/08 5/109
6,363,559 B1 * 4/2002 Saxon ..... A47C 21/006 5/694
6,684,423 B2 * 2/2004 Godette ..... A47C 21/006 5/600
6,968,806 B2 * 11/2005 Helwig ..... A01K 1/0353 119/28.5
7,013,588 B2 * 3/2006 Chang ..... A43B 1/0054 36/141
7,322,058 B2 * 1/2008 Long ..... A47C 21/006 5/600
7,322,947 B2 * 1/2008 Flick ..... A61G 7/05776 601/46
7,553,288 B2 * 6/2009 Cohen ..... A61H 23/0236 181/144
7,712,172 B2 * 5/2010 Jones ..... A61H 7/007 5/694
7,727,171 B2 * 6/2010 Ozaki ..... A61H 9/0078 601/105
7,988,649 B1 * 8/2011 Kost ..... A61H 23/02 601/15
8,185,986 B2 * 5/2012 Grimes ..... A61H 1/005 5/600
9,498,068 B2 * 11/2016 Lee ..... A61H 23/0254
9,788,660 B2 * 10/2017 Ermalovich ..... A47C 21/006
2003/0028132 A1 * 2/2003 Bastia ..... A61H 23/0254 601/57
2005/0015027 A1 * 1/2005 Kojima ..... A61H 23/0236 601/57
2005/0070827 A1 * 3/2005 Lee ..... A61H 23/0263 601/57
2006/0037146 A1 * 2/2006 Heng ..... A61G 7/0573 5/722
2006/0058713 A1 * 3/2006 Lee ..... A61H 23/02 601/57
2007/0213646 A1 * 9/2007 Han ..... A47G 9/1045 601/57
2015/0305510 A1 * 10/2015 Tarplee ..... A47C 20/041 601/57
2015/0313369 A1 * 11/2015 Tarplee ..... A61H 23/0254 601/57
2018/0220805 A1 * 8/2018 Rawls-Meehan .... A47C 21/006

* cited by examiner

MASSAGE MOTOR SUSPENSION SYSTEM

REFERENCE TO RELATED APPLICATIONS

This application relies on the priority of U.S. provisional application Ser. No. 62/215,501 filed on Sep. 8, 2015 entitled MASSAGE MOTOR SUSPENSION SYSTEM, the disclosure of which is incorporated herein by reference.

BACKGROUND

Field

This invention relates generally to the field of adjustable beds and more particularly to a structure for supporting a massage motor for attachment to mattress supporting planes in the bed for improved energy direction.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping.

Development of the articulating or adjustable beds for personal or home use has been further enhanced with the introduction of massage units to provide restful massage for the upper or lower back, thighs or lower legs. Transmission of the vibratory energy to the mattress may be significantly damped by the material of the mattress and is also impacted by the supporting structure for the massage motor. Prior art beds typically employ a box structure or covered shell for mounting of the motor to the mattress support element.

It is therefore desirable to provide a support structure for massage motors allowing greatest efficiency in directing energy of the motor into useful massage action.

SUMMARY

The embodiments disclosed herein overcome the shortcomings of the prior art by providing a massage motor suspension system having a frame which is secured to a planar support. A sling supporting a massage motor is resiliently suspended from the frame. A massage holder clipped to the massage motor engages a bottom surface of a mattress on the planar support through an aperture in the planar support.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1:
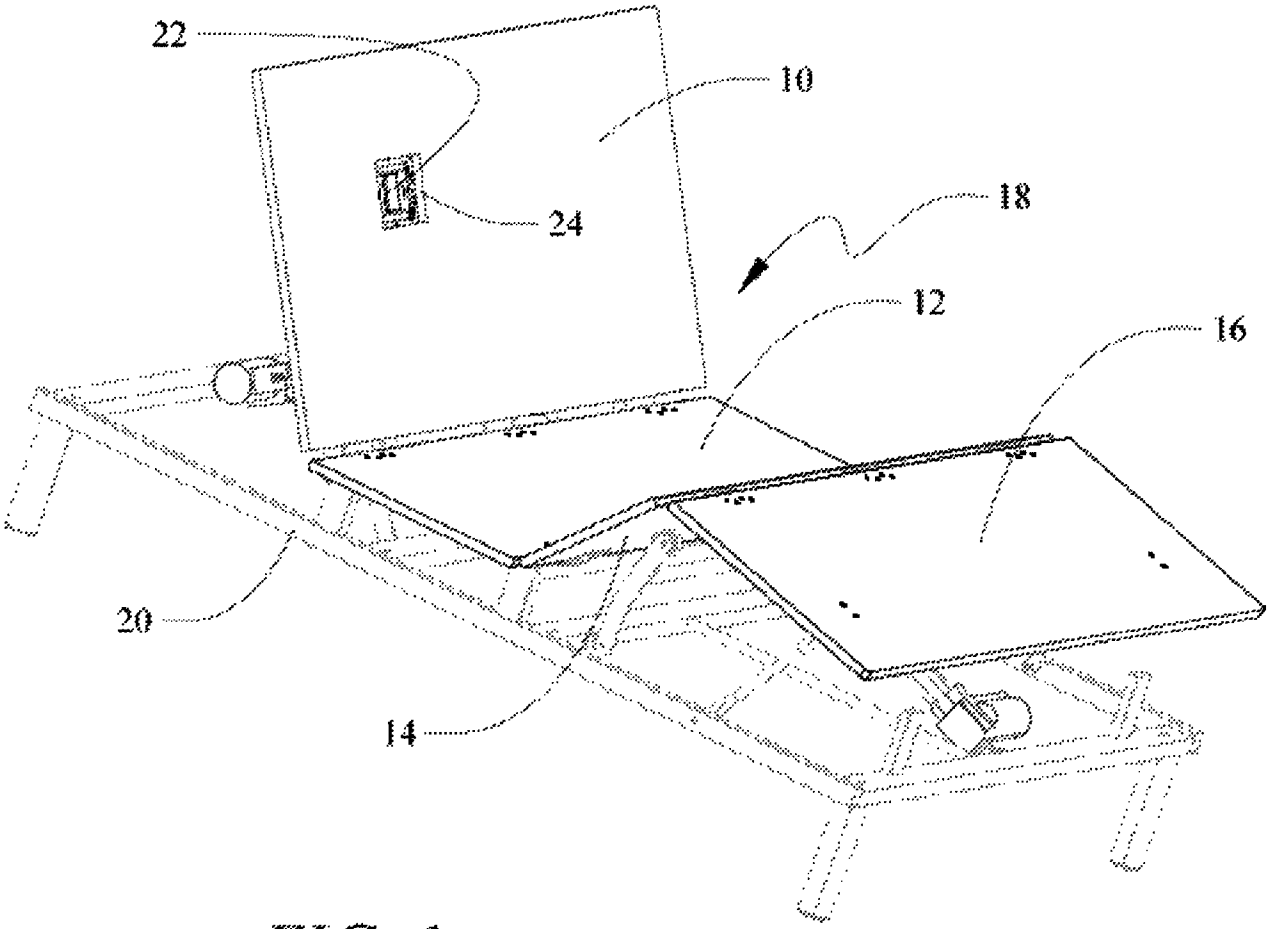
FIG. 1 is an front isometric view of an articulating bed usable with the present embodiment in an articulated position.

Embodiments shown in the drawings and described herein provide support for a massage motor in an articulating bed. Shown in FIG. 1 are the elements of the articulating structure for the bed in an upwardly articulated position for all moving elements, include a head portion planar support 10, a seat portion planar support 12, a thigh portion planar support 14 and a foot portion planar support 16. The planar support of each of the articulating elements form a combined articulating structure generally designated 18 for reference for supporting a mattress. The articulating structure is supported on a bed frame 20. Motion of the articulating elements may be achieved as disclosed in U.S. patent publication no. U.S.-2014-0201916 A1 published on Jul. 24, 2014 entitled ARTICULATING BED WITH SIMPLIFIED ACTUATION having a common assignee with the present application, which is referenced as though fully set forth herein, or similar structure.

As seen in FIG. 1, a massage motor assembly 22 is provided for upper back massage (only one position of an exemplary massage motor is shown and those skilled in the art will recognize that multiple locations for massage motors to provide upper back, lower back, or leg massage for an occupant or both occupants of a double, queen or king bed may be present). An aperture 24 in the head portion planar support 10 allows transmission of the energy from the massage motor into the mattress (not shown).

Figure 2A:
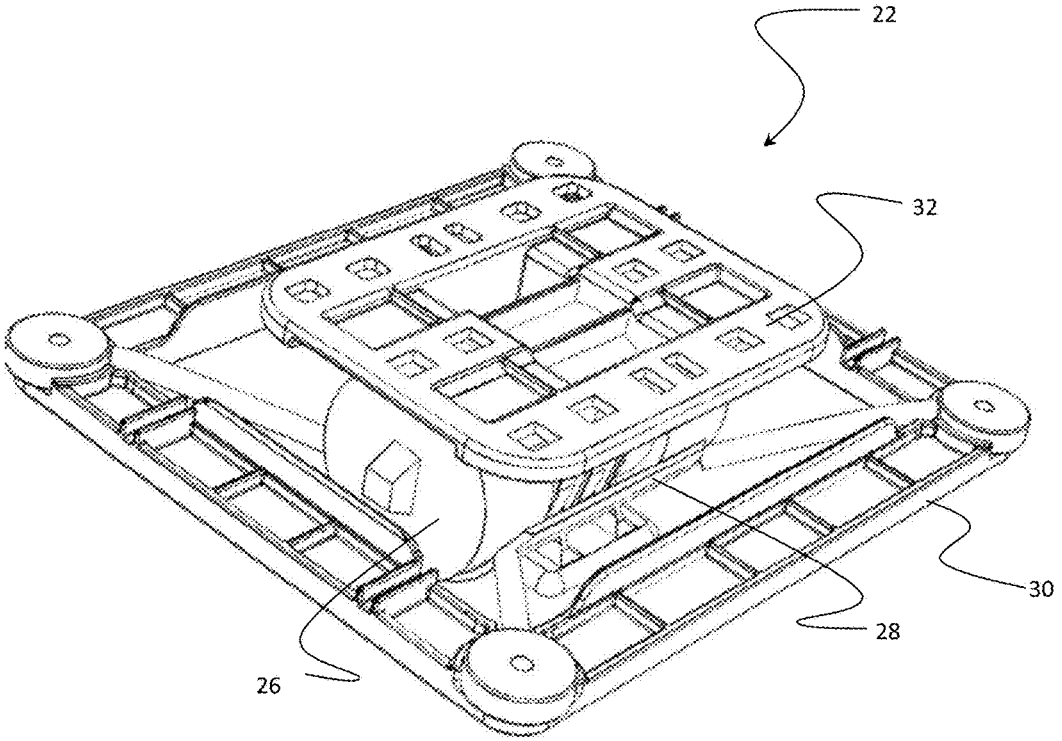
FIG. 2A is an isometric view of the exemplary embodiment in the assembled condition.
Figure 2B:
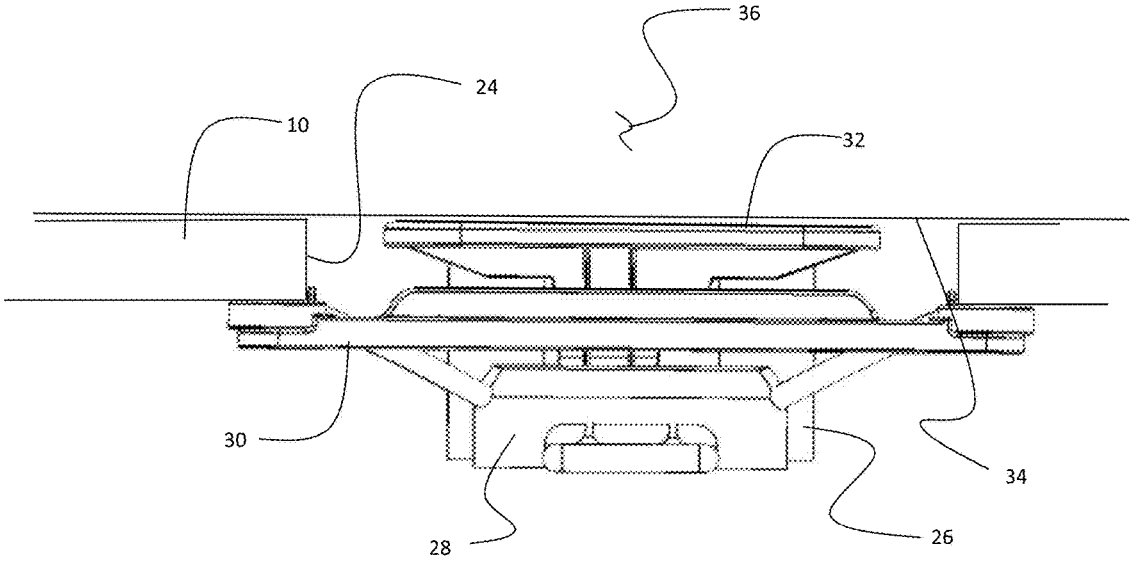
FIG. 2B is a partial section side view of the exemplary embodiment in the assembled condition as inserted in a support plane of the exemplary articulating bed of FIG. 1.

To enhance the efficiency in assembly of the massage motor into the articulating elements of the bed and to provide greater energy focus and improved massage characteristics, the present embodiment of the suspension system for the message motor assembly 22 shown in FIGS. 2A and 2B includes a massage motor 26 which is supported with a sling 28 suspended in an attachment frame 30. A message holder 32 clips to the massage motor 26 to transmit vibratory motion from the motor directly into the mattress.

As best seen in FIG. 2B, the frame 30 supports the sling 28 to position the motor 26 and clipped massage holder 32 for engagement with a bottom surface 34 of the mattress 36 as supported on the upper body planar support 10. The massage holder 32 extends through the aperture 24 in the planar support 10 to contact the bottom surface 34 of the mattress 36.

Figure 3:
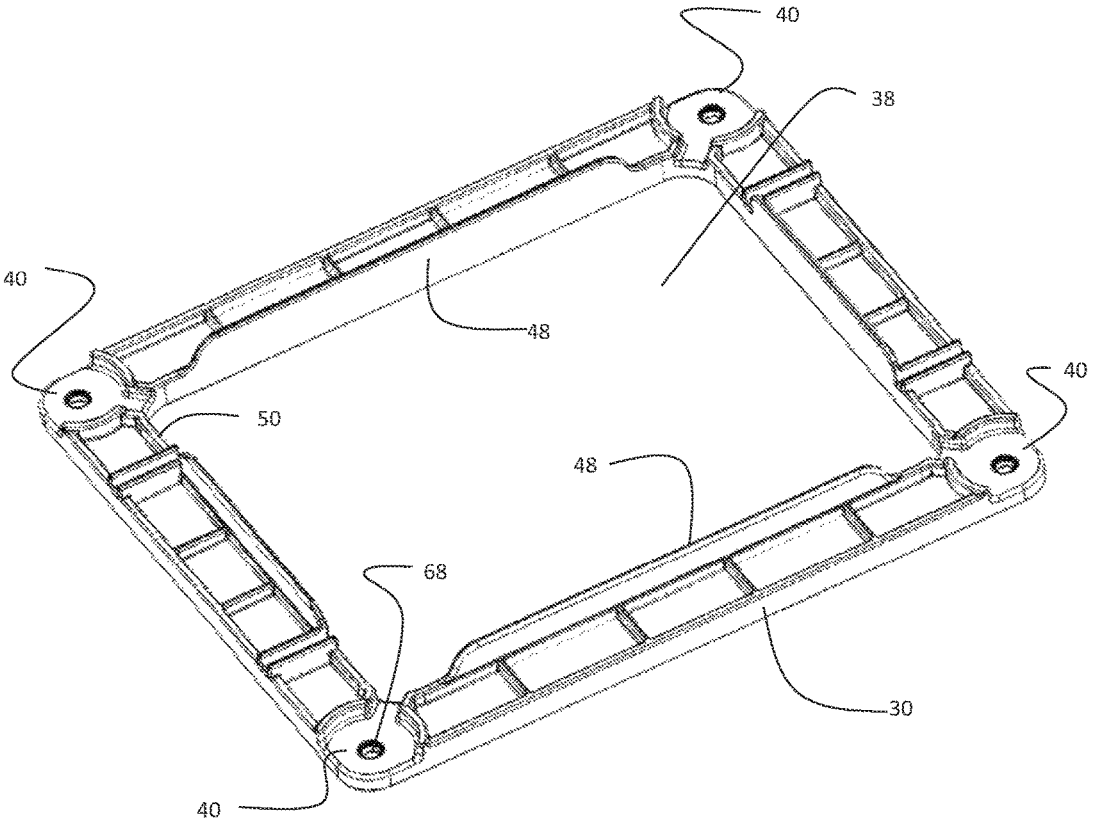
FIG. 3 is a an isometric view of the frame.
Figure 4:
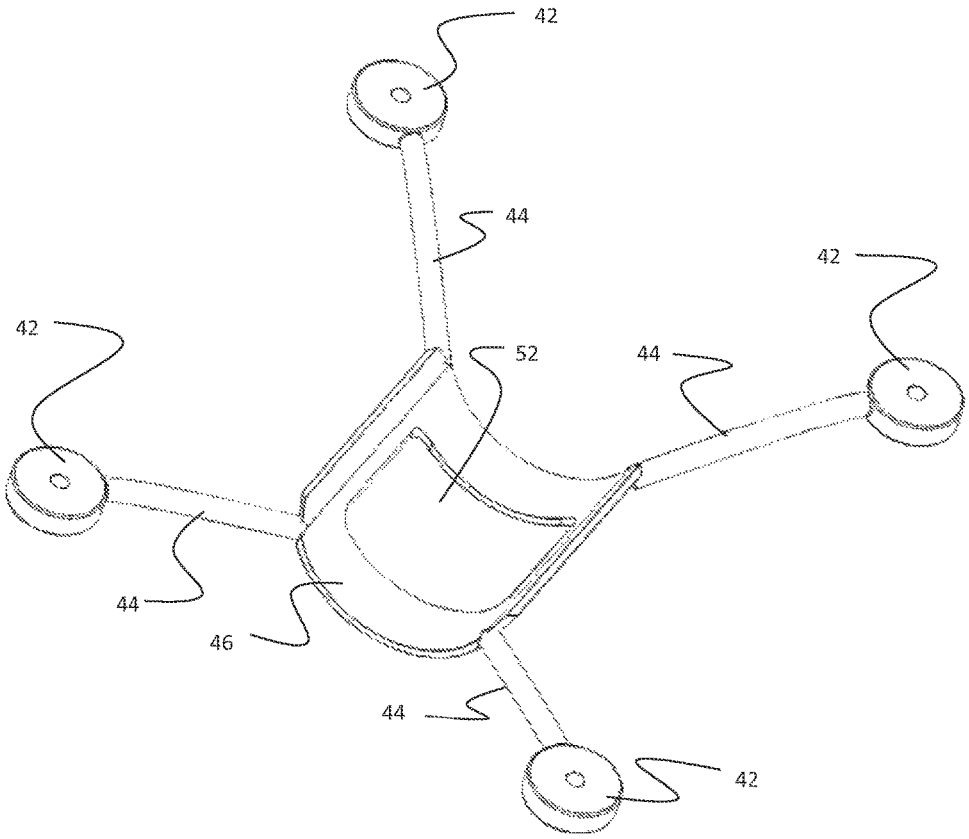
FIG. 4 is an isometric view of the sling.
Figure 5:
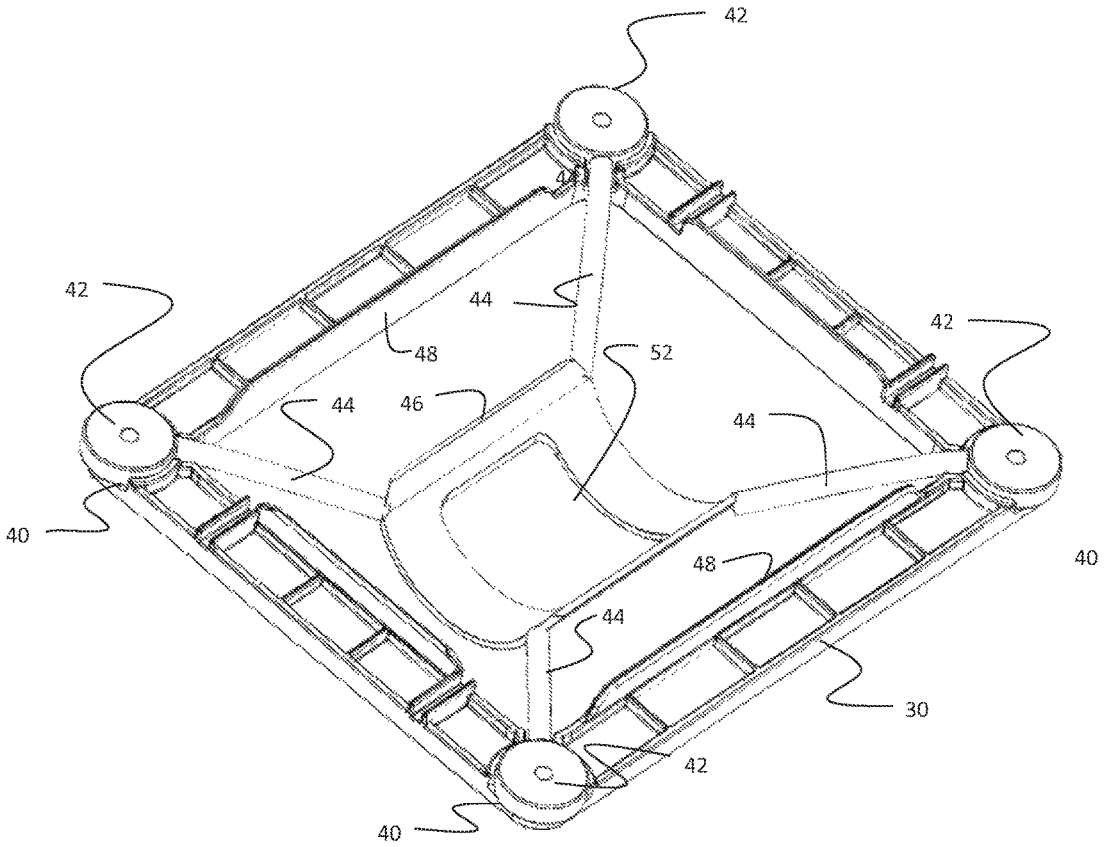
FIG. 5 is an isometric view of the sling inserted in the frame.

The frame 30 and sling 28 are shown in FIGS. 3 and 4 respectively. The frame 30 is rectangular for the embodiment shown and has a central mating aperture 38 for alignment with the aperture 24 in the planar support 10. Pad recesses 40 are located at corners of the frame to engage support pads 42 on the sling as seen in FIG. 5. Resilient legs 44 extend from the support pads to a motor support blanket 46. For the embodiment shown in the drawings, central aperture 30 is substantially identical in size to aperture 24 in the planar support 10. Upstanding flanges 48 extend from an inner periphery 50 of the frame for additional rigidity in the frame and to engage the walls of aperture 24. The support blanket 46 includes an engagement aperture 52 which receives a lower flange on the massage motor 26 as will be described in greater detail subsequently. In exemplary embodiments the sling is fabricated from molded rubber. While rectangular in the embodiment shown, frame 30 and apertures 24 and 38 may be circular or other geometric shape as desired.

Figure 6:
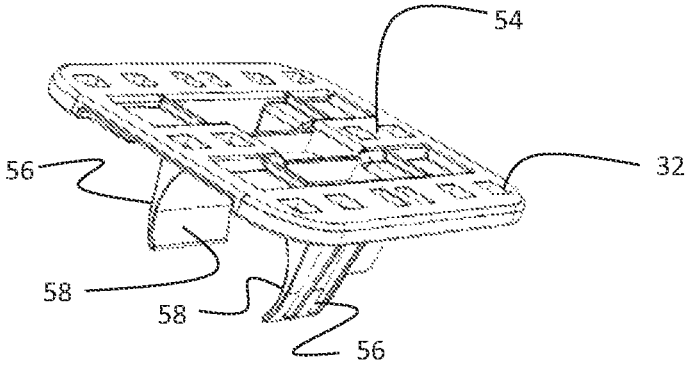
FIG. 6 is an isometric view of the motor clip.
Figure 7:
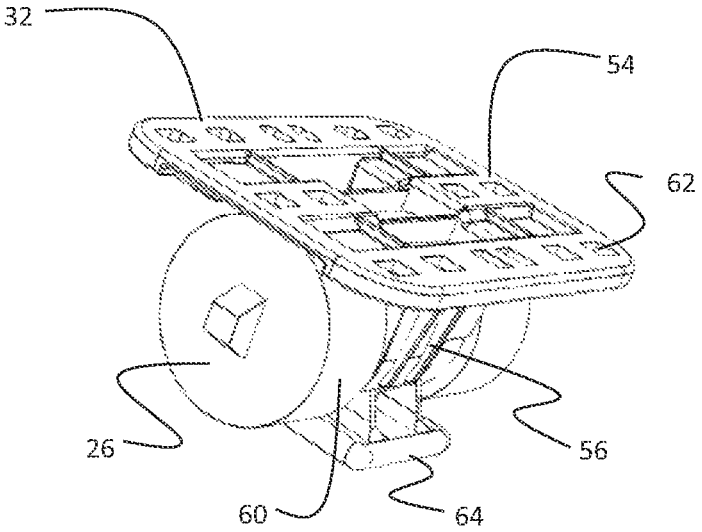
FIG. 7 is an isometric view of the motor clip as installed on the motor.
Figure 8:
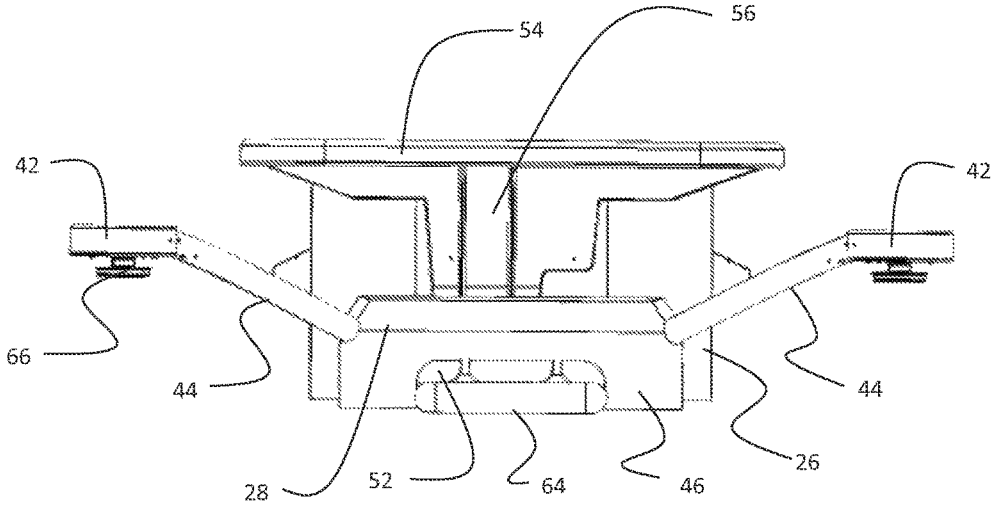
FIG. 8 is an isometric view of the motor and clip installed in the sling; and, FIG. 9 is a flow chart of a method for supporting a massage motor in an articulating bed.

The massage holder 32 is shown in FIG. 6 and incorporates a planar flange 54 to engage the bottom surface 34 of mattress 36. Resilient clip arms 56 depend from the planar flange 54 with inner surfaces 58 contoured to be received around a cylindrical body 60 of the motor 26 as seen in FIG. 7. Flange 54 may incorporate a plurality of flow apertures 62 to prevent entrapment of air between the flange and mattress bottom surface during vibratory excursions thereby maintaining intimate contact of the flange and surface. Motor lower flange 64 is received in the engagement aperture 52 of the support blanket 46 as seen in FIG. 8. The motor 26 with attached massage holder 32 is suspended by support blanket 46 and resilient arms 44 of the sling 28. Support pads 42 may incorporate tabs 66 which are received in holes 68 in the pad recesses 40 of the frame 30 (as seen in FIG. 3) to assist in retaining the support pads in the recesses. Additionally as seen in FIG. 2B, when engaged with the planar support 10, the frame 30 engages the support pads 42 between the recesses 40 and planar support 10. The frame 30 may be secured to the planar support 10 with screws or other fasteners.

Figure 9:
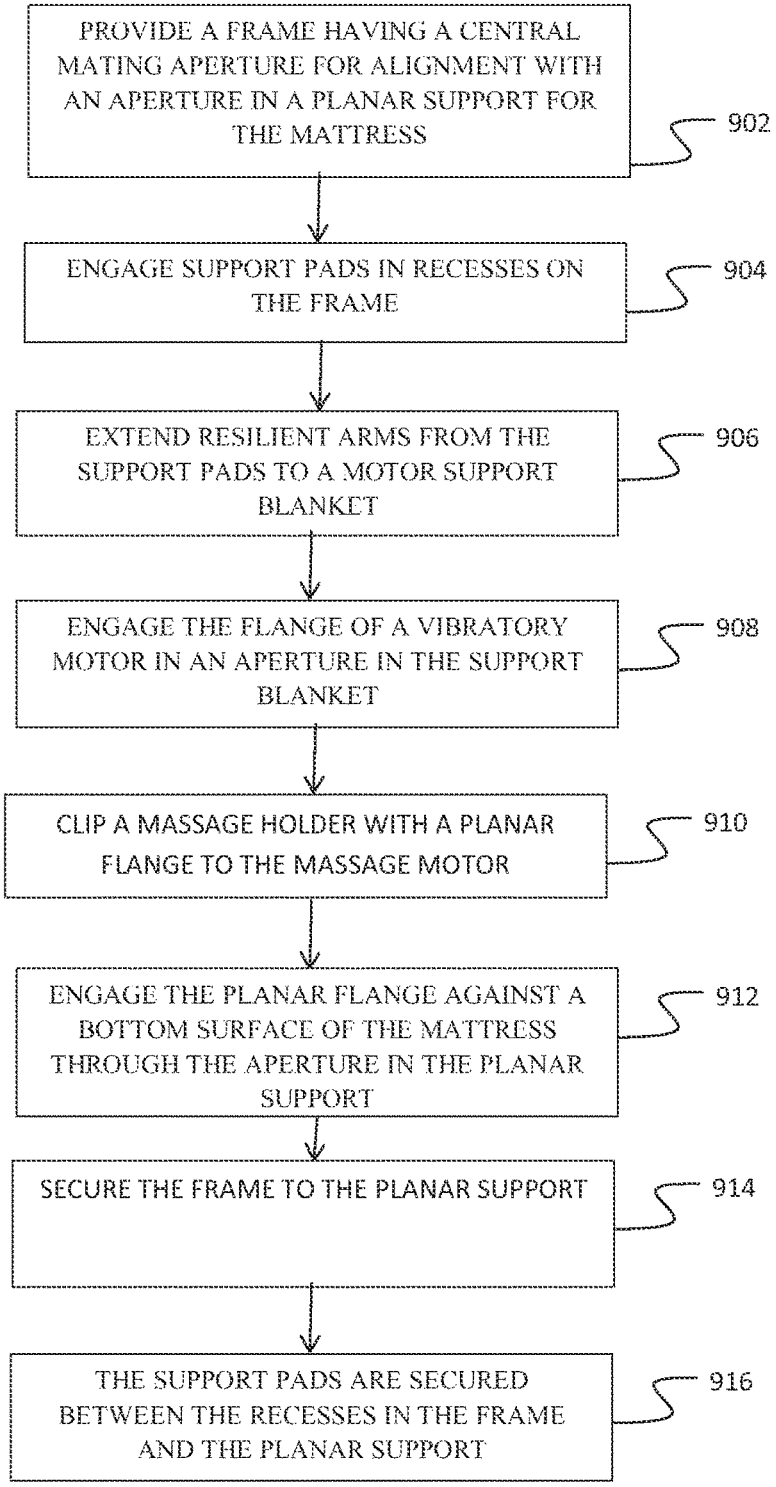

As seen in FIG. 9, a method for engaging a massage motor to a mattress in an articulating bed may be accomplished by providing a frame having a central mating aperture for alignment with an aperture in a planar support for the mattress, step 902. Support pads are engaged in recesses on the frame, step 904, and resilient arms are extended from the support pads to a motor support blanket, step 906. The flange of a vibratory motor is engaged in an aperture in the support blanket, step 908 and a massage holder with a planar flange is clipped to the massage motor, step 910. The planar flange is engaged against a bottom surface of the mattress through the aperture in the planar support, step 912, by securing the frame to the planar support, step 914. The support pads are secured between the recesses in the frame and the planar support, step 916.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A massage motor suspension system comprising:

a frame, said frame secured to a planar support;

a sling supporting a massage motor and resiliently suspended from the frame, said sling comprising a plurality of support pads engaged by the frame;

a resilient arm extending from each support pad; and, a blanket attached to each resilient arm; and, a massage holder clipped to the massage motor, said massage holder engaging a bottom surface of a mattress on the planar support through an aperture in the planar support.

2. The massage motor suspension system as defined in claim 1 wherein the blanket incorporates an aperture to receive a flange on the massage motor.

3. The massage motor suspension system as defined in claim 1 wherein the frame includes a plurality of recesses to receive the plurality of support pads.

4. The massage motor suspension system as defined in claim 1 wherein the frame includes a central mating aperture aligned with the aperture in the planar support.

5. The massage motor suspension system as defined in claim 4 wherein the central mating aperture is substantially identical in size to the aperture in the planar support and the frame further includes upstanding flanges extending from an inner periphery of the frame to engage walls of the aperture in the planar support.

6. The massage motor suspension system as defined in claim 1 wherein the massage holder comprises:

a planar flange;

resilient clip arms depending from the planar flange adapted to engage a cylindrical body of the motor.

7. The massage motor suspension system as defined in claim 6 wherein the planar flange includes a plurality of flow apertures.

* * * * *